US008282175B2

(12) United States Patent
Herper et al.

(10) Patent No.: US 8,282,175 B2
(45) Date of Patent: Oct. 9, 2012

(54) OPENING DEVICE FOR FURNITURE PARTS WHICH ARE MOVEABLE RELATIVE TO ONE ANOTHER

(75) Inventors: Markus Herper, Müehltal (DE); Boris Krüdener, Darmstadt (DE)

(73) Assignee: Grass GmbH & Co. KG, Reinheim (DE)

( * ) Notice: Subject to any disclaimer, the term of this patent is extended or adjusted under 35 U.S.C. 154(b) by 468 days.

(21) Appl. No.: 12/438,695

(22) PCT Filed: Jul. 14, 2007

(86) PCT No.: PCT/EP2007/006269

§ 371 (c)(1),
(2), (4) Date: Nov. 20, 2009

(87) PCT Pub. No.: WO2008/022673

PCT Pub. Date: Feb. 28, 2008

(65) Prior Publication Data

US 2011/0131884 A1 Jun. 9, 2011

(30) Foreign Application Priority Data

Aug. 24, 2006 (DE) ..... 20 2006 013 028 U
Apr. 21, 2007 (DE) ..... 20 2007 005 782 U

(51) Int. Cl.
*A47B 95/02* (2006.01)
*A47B 88/00* (2006.01)
*E05F 1/00* (2006.01)

(52) U.S. Cl. ... 312/319.2; 312/329; 49/379; 292/DIG. 4

(58) Field of Classification Search ..... 312/326, 312/329, 319.2, 327, 328, 405; 49/379, 364; 292/DIG. 4
See application file for complete search history.

(56) References Cited

U.S. PATENT DOCUMENTS 1,214,018 A * 1/1917 Vleeschouwer et al. ..... 292/332
2,910,290 A * 10/1959 Buchanan ..... 49/30
4,302,660 A * 11/1981 Swanson et al. ..... 219/391

(Continued)

FOREIGN PATENT DOCUMENTS

DE 2419116 A1 11/1975

(Continued)

OTHER PUBLICATIONS

English Language Abstract for DE 20 2004 019238.

(Continued)

*Primary Examiner* — Darnell Jayne
*Assistant Examiner* — Andrew Roersma
(74) *Attorney, Agent, or Firm* — Norris McLaughlin & Marcus, P.A.

(57) ABSTRACT

An opening device including an elongate ejector ram mounted in a longitudinally displaceable manner in a housing and pretensioned at one end by a spring into a position in which it protrudes out of the housing and pushable back into the housing counter to the pretensioning. A releasable locking device locks the ejector ram in a position retracted in the housing. A tensioning device is provided forcibly displaces the ejector ram. When the movable furniture part is completely opened, a tensioning device forcibly displaces the ejector ram into the locking position retracted within the housing. The tensioning device converts the opening movement of the movable furniture part in the interior of the housing via a tensioning member having one end guided out of the housing into a movement pulling the ejector ram back into the retracted position.

11 Claims, 8 Drawing Sheets

U.S. PATENT DOCUMENTS

| | | | | |
|---|---|---|---|---|
| 5,458,412 | A * | 10/1995 | Lee et al. | 312/309 |
| 5,971,514 | A * | 10/1999 | Hayakawa | 312/319.2 |
| 6,338,536 | B1 * | 1/2002 | Ueno et al. | 312/405 |
| 2007/0103041 | A1 * | 5/2007 | Kropf et al. | 312/333 |
| 2008/0048538 | A1 * | 2/2008 | Karg | 312/319.2 |

FOREIGN PATENT DOCUMENTS

| | | | |
|---|---|---|---|
| DE | 20308223 | U1 | 8/2003 |
| DE | 20 2004 019238 | U1 | 2/2005 |
| DE | 10333925 | A1 | 3/2005 |
| DE | 20 2005 016 188 | U1 | 3/2006 |
| EP | 1314842 | A1 * | 5/2003 |
| WO | WO 2004101919 | A1 * | 11/2004 |

OTHER PUBLICATIONS

English Language Abstract for DE 10333925.
English Language Abstract for DE 2419116.
English Language Abstract for DE 20 2005 016 188.
English Language Abstract for DE 20308223.

* cited by examiner

Fig. 14a
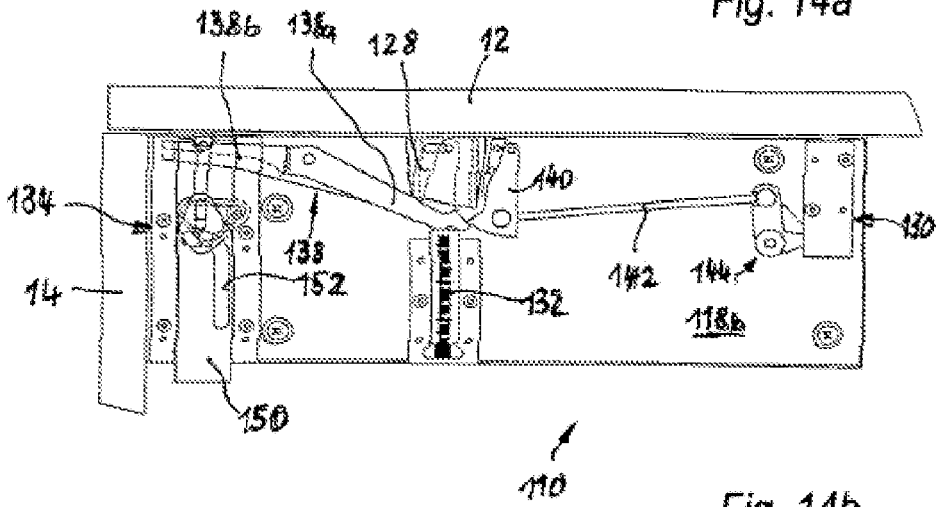
Fig. 14b
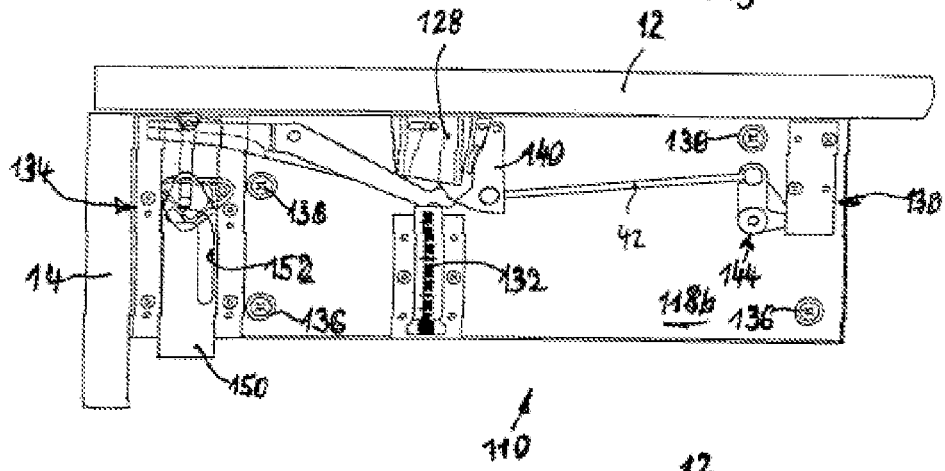
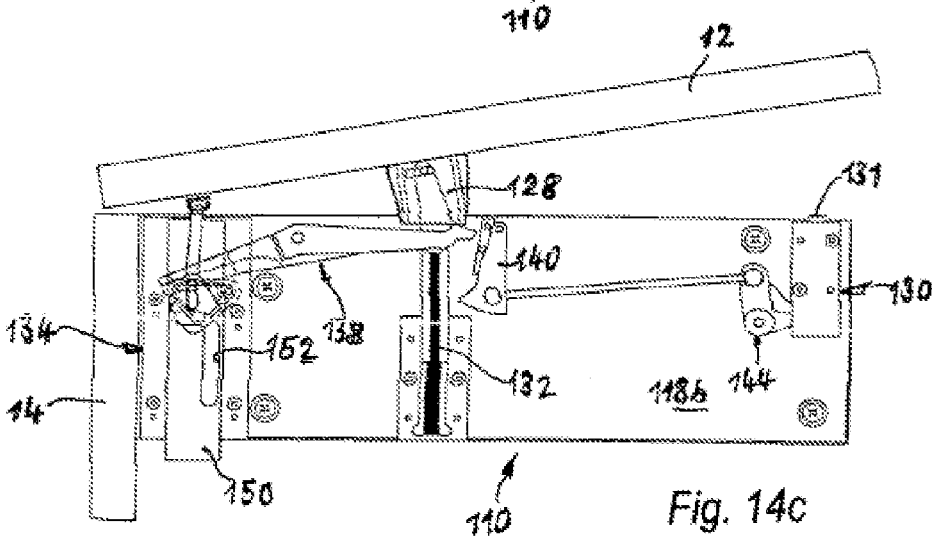
Fig. 14c

OPENING DEVICE FOR FURNITURE PARTS WHICH ARE MOVEABLE RELATIVE TO ONE ANOTHER

This application is a 371 application of PCT/EP2007/006269 filed Jul. 14, 2007, which claims priority to the German application 20 2006 013 028.4 filed Aug. 24, 2006 and German Application 20 2007 005 782.2 filed Apr. 21, 2007.

BACKGROUND OF THE INVENTION

1. Field of the Invention

The invention relates to an opening device for furniture parts which are movable relative to one another such as door leaves, flaps and the like which are pivotably articulated on a furniture carcass with an elongate ejector ram which is mounted so as to be longitudinally movable in or on a housing which can be fixed on one of the furniture parts which are movable relative to one another, wherein the ejector ram is biased by a spring with one end thereof into a position projecting out of the housing in the direction of the respective other furniture part and can be forced back against the spring bias into the interior of the housing, a locking device being provided which locks the ejector ram in the position in which it is retracted into the housing and can be unlocked by manipulation by a user.

2. Description of Related Art

For door leaves, flaps and the like which are articulated on the carcass of cabinets, closure fittings—for example catches—have been developed which are not only to be installed separately on the carcass or the door leaf but also integrated into the hinges which enable the pivot movement, and during the operation of closing a door leaf as it approaches the closed position these closure fittings pull the door leaf resiliently into the closed position and also retain it in the closed position. In order in this case to avoid or to reduce impact noises and vibrations of the piece of furniture, damping devices for the concluding closing operation of the door leaves have been developed recently which can also be mounted separately on the carcass or on the door leaf or can be integrated into the hinges.

In an attempt to avoid, for visual/aesthetic reasons, the handle fittings which are necessary for opening and closing the door leaves or flaps, so-called touch-latch fittings have been developed which apart from a locking function for the closed door flap are provided with an additional opening function which makes it possible for the door leaf situated in the closed position to be unlocked by a pressure additionally exerted in the direction into the interior of the carcass and to be endowed with a movement in the direction of opening by an integrated spring arrangement, so that the door leaf lifts off from the cabinet carcass by a small angular amount and it is possible to grip the rear face of the door leaf in the edge region and to open the door leaf—even without the presence of a handle fitting. Also such touch-latch fittings can be constructed as separate fittings which can be installed in the region of the carcass aperture or as fittings integrated into the hinge (e.g. DE 20 2004 019 238.1). A problem then occurs when, in the case of a piece of furniture, as the pivotable furniture part approaches the closed position a closing function—which if possible is also damped—and in addition an opening function corresponding to the function of touch-latch fittings is to be implemented, because then the spring tensions which effect the respective closing or opening function act in the opposing direction. The kinematic design of the touch-latch devices also means that the door leaf in the closed position must still have a certain play for movement in the closing direction in order to be able to release the door leaf from the closed position before the opening function is initiated. The gap which is inevitably necessary as a result between the rear face of the door leaf and the end faces of the carcass walls is undesirable in many cases both for visual/aesthetic reasons and also for practical reasons.

SUMMARY OF THE INVENTION

The object of the invention therefore is to create an opening device for furniture parts pivotably articulated on a carcass which makes it possible for such a furniture part, for example a door leaf, which is closed completely, i.e. until its rear face abuts the end edges of a cabinet carcass, and is retained in the closed position by a spring-biased closure mechanism, to pivot automatically by a certain angular amount in the direction of opening without the attachment of handle fittings for the exertion of effective forces which act in the opening direction after actuation by the user.

Starting from an opening device of the type mentioned in the introduction, this object is achieved according to the invention in that in the housing a tensioning device is provided which moves the ejector ram forcibly into the locked position in which it is retracted into the housing when the movable furniture part is completely open, whereby by means of a tensioning element which with one end projecting out of the housing engages on the movable furniture part in the interior of the housing the tensioning device converts the opening movement of the movable furniture part into a retraction movement of the ejector ram into the retracted locked position. By the use of such an additional tensioning device which converts the predominant part of the opening movement of the pivotable furniture part into a displacement of the ejector ram over a relatively short distance, the movable furniture part can be moved during the closing operation into the completely closed position without the need at the end of the closing movement to overcome a resilient counterpressure, as is necessary in the known touch-latch fittings. Also there is no need for a gap between the movable furniture part, e.g. the rear face of a door leaf and the cabinet carcass, which is necessary for unlocking of touch-latch fittings from the closed position and provides the actuating path.

In a preferred embodiment of the invention the tensioning device has a two-armed lever component which is mounted in the housing so as to be pivotable about an axis at right angles to the longitudinal central axis of the ejector ram and of which one lever arm is in engaged connection in a free end region with the region of the ejector ram which is retained so as to be displaceable in the interior of the housing, whilst coupled to the end region of the other lever arm is an elongate rod component of which the free end which projects out of the housing wall facing the door leaf is provided with means for traction- and/or pressure-transmitting fixing on the inner face of the door leaf.

In this case the engaged connection of the first lever arm of the lever component to the ejector ram is advantageously constructed kinematically in such a way that the lever arm is coupled to the ejector ram so as to be pivotable and in addition displaceable by a predetermined amount parallel to the longitudinal axis of the ejector ram.

In this case the lever component is preferably formed by two parallel two-armed levers which are spaced from one another, wherein the clear distance between the lever arms of the two-armed lever on the ejector ram side is substantially the same as or only slightly greater than the external diameter of the ejector ram.

In this way the construction can be such that the engaged connection of the end regions of the lever arms of the lever on the ejector ram side has lugs which engage in each case in an associated longitudinal groove of predetermined length in the opposing outer face in the ejector ram. Thus this engaged connection constitutes, as it were, a simple crank/groove connection which produces the pivotable and longitudinally displaceable coupling of the lever component on the ejector ram.

In a preferred alternative embodiment of the invention the lever component is constructed so that in addition to its pivotable mounting it is displaceable in the vertical direction by a predetermined amount at right angles to the longitudinal central axis of the ejector ram in order that the component of motion at right angles to the longitudinal central axis of the ejector ram produced during the pivoting of the lever component can be compensated for by a displacement of the lever component in the opposite direction.

In this case the construction is then such that the pivot axis of the lever component is formed by two aligned lugs each projecting from the outer faces of the lever which face away from one another, the lugs projecting in each case into an associated groove which extends by the predetermined amount in the vertical direction in the inner surfaces of the opposing walls of the housing.

The rod component which transmits the opening movement of the door leaf to the lever component is then advantageously likewise coupled on the second lever arm so as to be pivotable and displaceable by a predetermined amount in the direction of the longitudinal central axis of the rod component. In a particularly simple manner this is possible due to the fact that in its end region within the housing the rod component has a loop-like elongate eye which is closed on both sides and through which passes a bolt which is retained in the end regions of the second lever arm of the lever of the lever component.

The other end of the rod component—which projects out of the housing—is then advantageously articulated on a fixing bracket which can be fixed on the inner face of the movable furniture part, i.e. the door leaf, so as to be pivotable about an axis extending at right angles and perpendicular to the longitudinal axis of the rod component.

The locking device, which locks the ejector ram in the retracted position in the housing and can be unlocked by manipulation by a user, advantageously has a pawl which is retained in the housing so as to be movable substantially at right angles to the direction of displacement of the ejector ram and can be brought into latching engagement on its end within the housing with a latching recess provided in the ejector ram, wherein the positioning of the latching recess in the ejector ram is such that in the retracted position of the ejector ram into the housing the pawl is aligned with the latching recess. In this case the pawl is preferably biased in resilient latching engagement with the latching recess.

The ejector ram can then be released from its retracted position in the housing by suitable means for remote release of the pawl from the latching engagement with the latching recess, so that due to the bias of the associated spring acting on the ejector ram this latter is guided into the position in which it projects out of the housing, thereby triggering the initial opening of the movement of the door leaf. The means for remote release of the pawl may be formed for example by actuating knobs connected to the pawl by way of cable pulls or coupling members or alternatively can be formed by pressure-sensitive actuating surfaces of electrical switches recessed in the door leaf or cabinet carcass.

In a modified embodiment of the opening device according to the invention the construction may also be such that a two-armed lever component with two lever arms pointing substantially in opposing directions is mounted so as to be pivotable in the housing, that the biased ejector ram is disposed in the end region of one lever arm and a latching component of the locking device locks the end of the lever arm in the pivoted position of the lever component associated with the retracted position of the ejector ram, and that the tensioning and stopping device is coupled to the end region of the other lever arm of the lever component.

In this case with regard to the smallest possible overall height of the opening device the construction is preferably such that the housing is dimensioned in the longitudinal direction of the pivot axis of the lever component so that the clear spacing between the substantially flat top walls of the housing which accommodate the lever component is approximately equal to the thickness of the lever component in the region of the pivot axis, wherein the top walls of the housing are at least partially closed along their edges on the ejector ram side by a low elongate side wall with a through opening for the ejector ram. In this case because of the small spacing between the top walls of the housing the possibility arises of mounting the housing on the inner face of the top wall or the base of the cabinet carcass.

The ejector ram then advantageously has the shape of a flat plate component which is displaceably guided between the inner faces of the top walls of the housing and has on the end wall side a flat pressure surface which in the retracted position of the ejector ram in the housing only projects slightly over the housing side wall in the through opening.

In an advantageous embodiment of the invention the latching component of the locking device is constructed as a pivot lever pivotably mounted between the top walls of the housing with a latching projection which is provided on its free end opposite the end on the pivot bearing side and which in the retracted locked positions engages under the end of the lever arm of the lever component associated with the ejector ram and thus fixes the lever component in the retracted locking position counter to the bias acting on it.

In this case it is advantageous if the pivot lever is coupled by gearing to a trigger unit which is disposed so as to be spaced from the pivot lever and has a thrust piece which is biased into a position projecting slightly over the side wall of the housing and of which the insertion movement produced when a pressure is exerted in the direction of the interior of the housing is converted by way of the geared coupling into a pivoting of the pivot lever for the purpose of a release of the locked end of the associated lever arm.

On the end of the pivot lever opposite the end on the pivot bearing side there is advantageously disposed an elongate tension/compression element of which the other end is connected to a lever arm of a pivotable toggle lever, the other lever arm of which is coupled to the thrust piece.

In an advantageous alternative embodiment the ejector ram is articulated on the associated lever arm of the lever component so as to be pivotable about an axis offset into the interior of the housing with respect to its pressure surface and—preferably—is disposed so as to be additionally displaceable by a predetermined amount substantially parallel to the pressure surface.

The ejector ram can have the shape of a flat body which is delimited so as to be flat on both sides in the regions opposite the top walls of the housing and of which the thickness measured between the opposing flat surfaces corresponds approximately to the clear spacing of the inner face of the top walls of the housing.

The tensioning and stopping device coupled to the locking device advantageously has a rod component as tensioning element coupled to the side of the movable furniture part inside the carcass on the one hand and to a flat slide mounted displaceably in the interior of the housing, wherein the slide is provided with a crank-like control groove which extends substantially in a straight line over the greater part of its length but which merges into a short end portion extending substantially at right angles to the straight region, and a control projection which is provided on a flat sector-shaped control disc pivotably disposed in the housing engages in the control groove and which in the closed position of the movable furniture part is located in the transversely extending end portion of the control groove and which, when the movable furniture part is opened, is moved into the straight portion of the control groove by the movement transmitted by the rod component to the slide as the control disc pivots, and thus enables the slide, which until then was retained by the engagement of the control projection in the control groove portion extending at right angles to the straight control groove portion, to move in the direction out of the interior of the carcass.

In an advantageous embodiment the rod component is coupled to the slide so as to be pivotable and displaceable to a predetermined extent in the direction of displacement of the slide.

When the opening device constructed in the manner according to the invention is disposed on a cabinet with a door leaf articulated pivotably on the cabinet carcass, the housing of the opening device is preferably disposed in the cabinet carcass with one of the housing top walls resting on the inner face of the upper top wall or—alternatively—of the base of the cabinet carcass in such a way that the pressure surface of the ejector ram, which in the retracted position projects only slightly from the side wall of the housing, rests substantially on the inner face of the door leaf which is in the closed position.

BRIEF DESCRIPTION OF THE DRAWING

In the following description the invention is explained in greater detail in connection with the drawings, in which:

FIGS. 14*a* to 14*f* each show views corresponding to FIGS. 13*a* to 13*f* in the opposite viewing direction upwards from below.

DETAILED DESCRIPTION OF THE INVENTION

Figure 1:
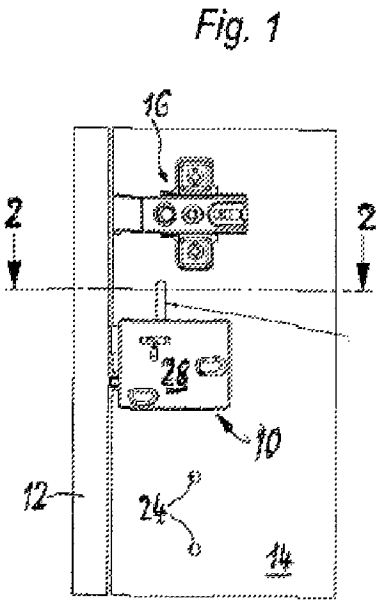
FIG. 1 shows a side view of a portion of the supporting wall of a cabinet carcass on which a portion of a door leaf in the closed position is pivotably mounted by means of a hinge, wherein a first embodiment of an opening device according to the invention which is fixed on the supporting wall is shown schematically below the hinge.
Figure 2:
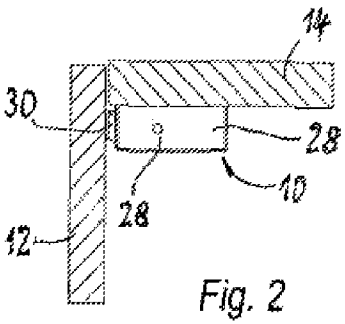
FIG. 2 shows a side view in the direction of the arrows 2-2 in FIG. 1.
Figure 3:
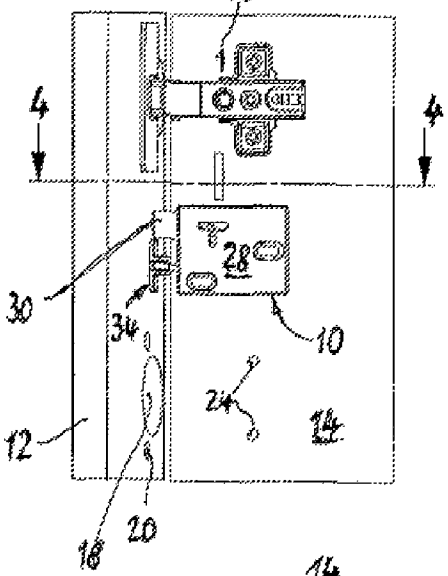
FIG. 3 shows a view corresponding to FIG. 1 in which the door leaf is shown in a position in which it is pivoted by approximately 10° in the opening direction relative to the closed position.

In FIGS. 1 to 3 a portion of a door leaf 12 is shown which is articulated in a manner which is known per se so as to be pivotable on a side wall—denoted hereafter as a supporting wall 14—of the carcass of a cabinet. The pivotable articulation of the door leaf 12 on the supporting wall 14 takes place by means of a conventional jointed hinge, of which only the hinge which pivotably couples the door leaf in the upper region to the supporting wall and is constructed as a four-bar hinge 16 is shown in the drawings, whilst the necessary second hinge which couples the said components in the lower region is not yet installed. The drawing shows in this region only the cut-out 18 on the door side as well as the fixing hole 20 for the hinge cup 22 and the fixing holes 24 for fixing the supporting wall mounting parts of the hinge constructed as an elongate supporting arm 26.

An opening device denoted as a whole by 10 which is constructed in accordance with the invention and is fixed in the region of the supporting wall 14 on the door leaf side is shown schematically below the hinge 16.

The opening device 10 described in greater detail below in connection with FIGS. 7*a* to 9*b* has a housing 28 which is rectangular in the illustrated case, and the free end of an ejector ram 30 which is mounted so as to be longitudinally displaceable in the housing can project out of the housing wall on the door leaf side. Moreover, a rod component 33 which serves as a tensioning element also projects—below the ejector ram 30—and the end of the rod component outside the housing is mounted so as to be pivotable in a fixing bracket 34 fixed on the inner face of the door leaf 12.

The construction and the position of the functional components of the opening device 10 in different pivoted positions of the door leaf 12 relative to the supporting wall 10 is illustrated in FIGS. 7*a* to 9*b*.

Figure 4:
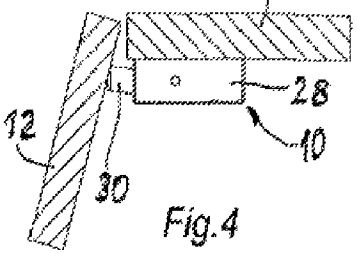
FIG. 4 shows a side view in the direction of the arrows 4-4 in FIG. 3.
Figure 5:
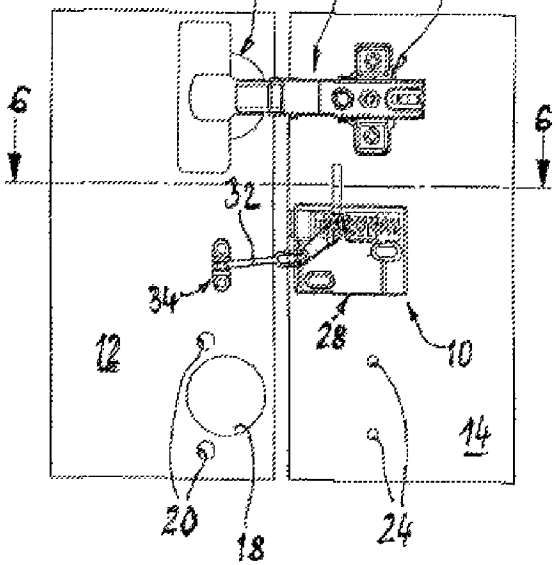
FIG. 5 shows a view corresponding to FIGS. 1 and 3 in which the door leaf is shown in position in which it is pivoted by 90° in the opening direction relative to the closed position.
Figure 6:
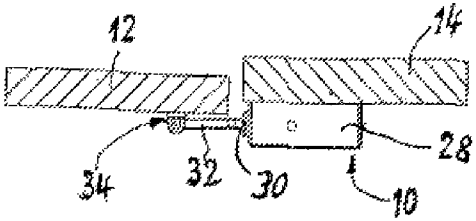
FIG. 6 shows a side view in the direction of the arrows 6-6 in FIG. 5.
Figure 9A:
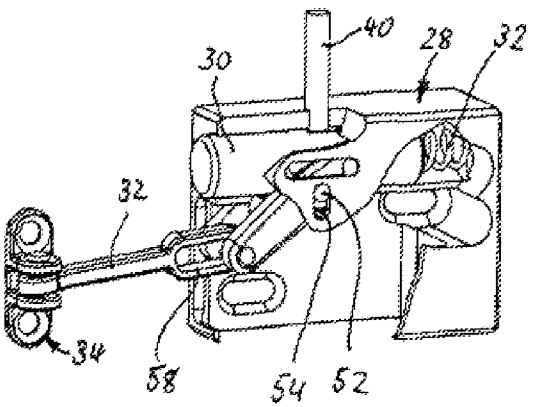
FIG. 9*a* shows a view corresponding to FIGS. 7*a* and 8*a* of the opening device in the open position of its functional components according to FIGS. 5 and 6.
Figure 9B:
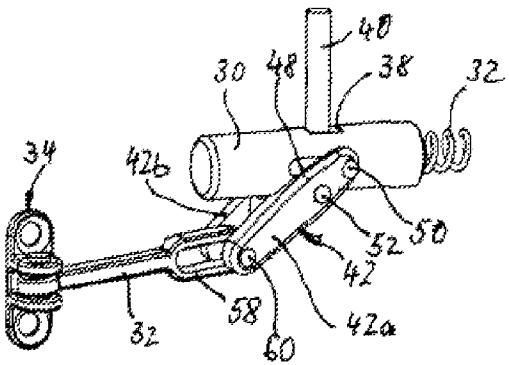
FIG. 9*b* shows a representation corresponding to FIG. 9*a* in the open position and without the housing.
Figure 8A:
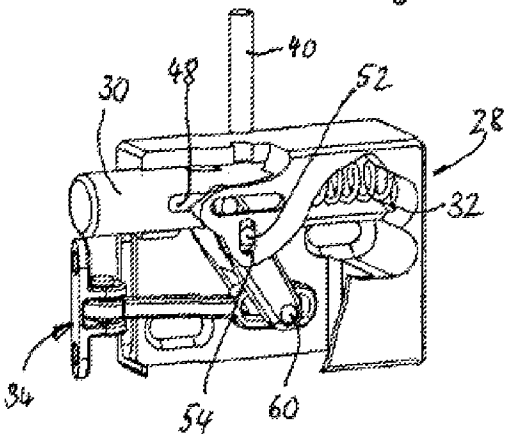
FIG. 8*a* shows an isometric view of the opening device corresponding to FIG. 7*a* in the partially opened position of its functional components corresponding to FIGS. 3 and 4.
Figure 8B:
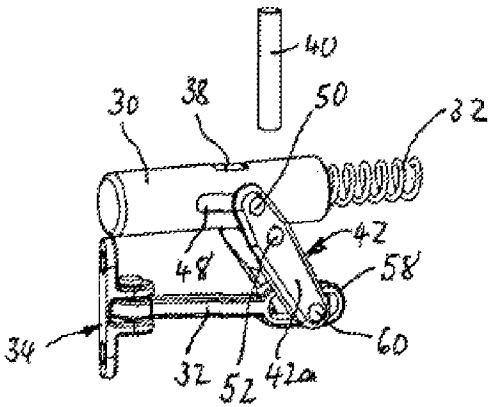
FIG. 8*b* shows a representation corresponding to FIG. 8*a* in the closed position and without the housing.
Figure 7A:
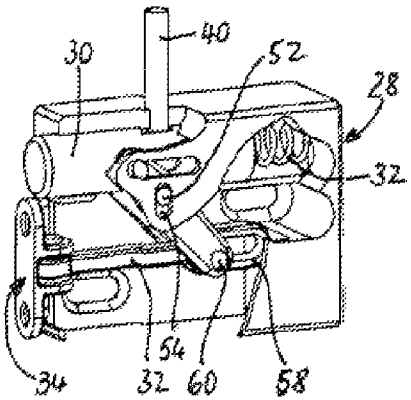
FIG. 7*a* shows the opening device illustrated schematically in FIGS. 1 to 6 in an isometric representation in which its functional components are shown in the position corresponding to the closed position according to FIGS. 1 and 2.
Figure 7B:
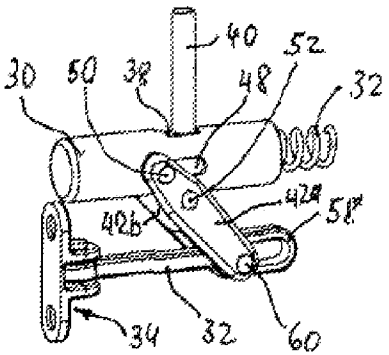
FIG. 7*b* shows a representation corresponding to FIG. 7*a* in the closed position and without the housing.

The ejector ram 30 which is displaceably mounted in the housing 28 is biased into the position shown in FIG. 8*a* in which it is pushed out of the housing 28 by a helical spring 32 which is under compression pretension and inserted between its end face within the housing and the opposing inner wall of the housing. In the region of the ejector ram directed towards the upper horizontal wall of the housing 28 there is provided a latching recess with which is associated a pawl 40 which passes displaceably through the housing wall and which in the position—shown in FIGS. 7*a* and 9*a*—in which it is retracted into the housing engages in the latching recess 38 and locks the ejector ram 30 against displacement into the extended position. If the pawl 40 is then raised by suitable manipulation and thus withdrawn from the latching recess 38, the compression pretension of the spring 32 forces the ejector ram 30 out of the housing. In this case the door leaf 12 which is initially in the closed position shown in FIGS. 1 and 2 is pivoted into the partially opened position shown in FIGS. 3 and 4 in which the door leaf 12 is lifted so far from the carcass of the cabinet that it can be gripped from behind and can be pivoted into the completely open position shown in FIGS. 5 and 6.

A lever component 42 which is formed by two two-armed levers 42*a*, 42*b* which are rigidly connected to one another is pivotably mounted in the housing 28. The end regions of the upper lever arms of the lever 42*a*, 42 engage around the ejector ram 30 in its opposing regions and are coupled to the ejector ram by way of a follower connection formed in each case by a projecting lug 50 engaging in an elongate groove 48 in the ejector ram 30. The pivot mounting of the lever component 42 in the housing 28 also takes place—below the ejector ram 30—in each case by a lug 52 which projects from the outer face of the lever 42*a*, 42*b*, each of the lugs engaging in an associated bearing receptacle constructed as a groove 54 which is provided in the vertical direction in the inner face of the wall of the housing 28. Thus in addition to the pivoting of the lever component 42 this mounting also allows a vertical displacement of the lever component 42 to the extent predetermined by the length of the groove 54.

The end of the aforementioned rod component 33 within the housing is coupled in the end regions of the lower lever arms of the lever 42*a*, 42*b*, wherein this end is constructed as an elongate loop-like eye 58 which is closed on both sides and which is traversed by a bolt 60 which is retained in the end region of the lower lever arms of the lever 42*a*, 42*b*. Thus the consequence of this type of coupling of the rod component 33 on the lever component 42 is that transmission of a longitudinal movement of the rod component 33 from the eye 58 via the bolt 60 to the lower lever arms of the lever 42*a*, 42*b* and vice versa only takes place if the closed end of the eye 58 which is at the rear in the direction of movement rests on the bolt. In the case of reversal of the movement the eye can then first of all move freely on the bolt by the amount of the loop length of the eye 58 without entraining the lower lever arms of the lever 42*a*, 42*b* and thus without pivoting of the lever component 42. Only when the opposing closed end of the eye 58 comes to rest on the bolt 60 is a further movement of the rod component 33 transmitted to the lever component 42 and converted into a pivoting of the lever component. Thus as a result between the functional components of the opening device 10 and the door leaf 12 a kinematic chain is created which leads from the closed position of the door leaf 12 shown in FIGS. 1, 2 and 7*a*, 7*b* of the drawings via the partially opened position of the door leaf 12 shown in FIGS. 3, 4 and 8*a*, 8*b* into the completely opened position of the door leaf shown in FIGS. 5, 6 and 9*a*, 9*b*. It can be seen from FIGS. 7 to 9 that in the closed door position when the pawl 40 engaging in the latching recess is released the ejector ram 30 is pushed out of the housing 28, whereby the lever component 42 still does not experience any pivoting due to the engaged connection via the lugs 50 engaging in the grooves 48. If the door leaf 12 which is pivoted by the ejector ram 30 into the partially opened position is then opened further, the rod component 33 is initially freely entrained by the pivoting movement until the end of the eye 58 within the housing comes to rest on the bolt 60. The lever component 42 is then pivoted due to the further pivoting movement of the door leaf into the position shown in FIGS. 9*a*, 9*b*, so that the ejector ram 30 is again forcibly retracted into the starting position by the pivoting movement in the appertaining groove 48. The pawl 40 then engages in the latching recess 38 and locks the ejector ram 30 in the inserted position. The door leaf can then be pivoted back into the closed position largely without force, whereby the functional components of the opening device are then pivoted or displaced again into the starting position shown in FIG. 7.

Figure 10:
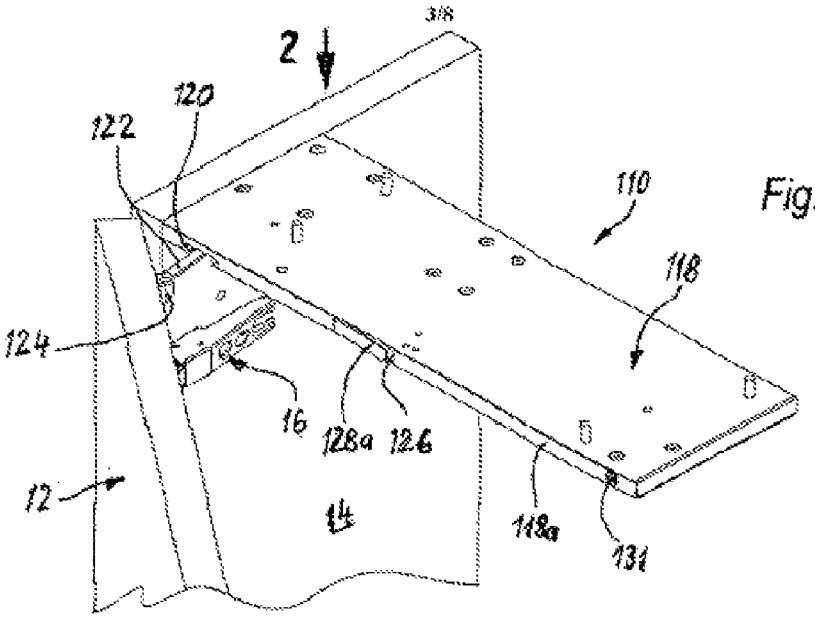
FIG. 10 shows an isometric view of the upper corner region of the side wall of a cabinet carcass, on which a door leaf illustrated in the partially open position is pivotably articulated, and of a second embodiment of an opening device constructed according to the invention which can be mounted on the inner face of the upper cabinet top wall (not shown)

The arrangement of a second embodiment of an opening device for a door leaf 12 according to the invention which is denoted overall by 110 is shown in FIG. 10 in the front upper corner region of a cabinet carcass of which only the upper corner region of the side wall 14 is shown, whilst the top wall, which closes off the carcass at the top and which has the opening device 110 fixed on its inner face directed into the interior of the carcass, is not shown for the sake of clarity. The door leaf 12 is pivotable by means of conventional jointed hinges about a vertical axis and articulated on the side wall or supporting wall 14. Only the upper hinge, which in the special case is constructed as a conventional four-bar hinge 16, is shown in the drawing.

The opening device 110 has a rectangular housing 118 which is elongate in plan view and is intentionally kept small in the vertical direction and which is disposed with the upper flat face flush on the top wall of the carcass and with one of the shorter low transverse walls in flush abutment on the inner face of the side wall or supporting wall 14. In the low front side wall 18*a* of the housing directed out of the interior of the carcass a through opening 120 is provided in the vicinity of the supporting wall 14 for a rod component 122, of which the free end projecting out of the housing 118 engages so as to be pivotable about a vertical axis on a fixing bracket 124 fixed on the inner face of the door.

An ejector ram 128 with a flat elongate pressure surface which rests on the inner face of the door leaf in the closed state of the door leaf 12 is disposed in a through opening 126 which is spaced further from the supporting wall 14 in the housing end wall 118.

Figure 11:
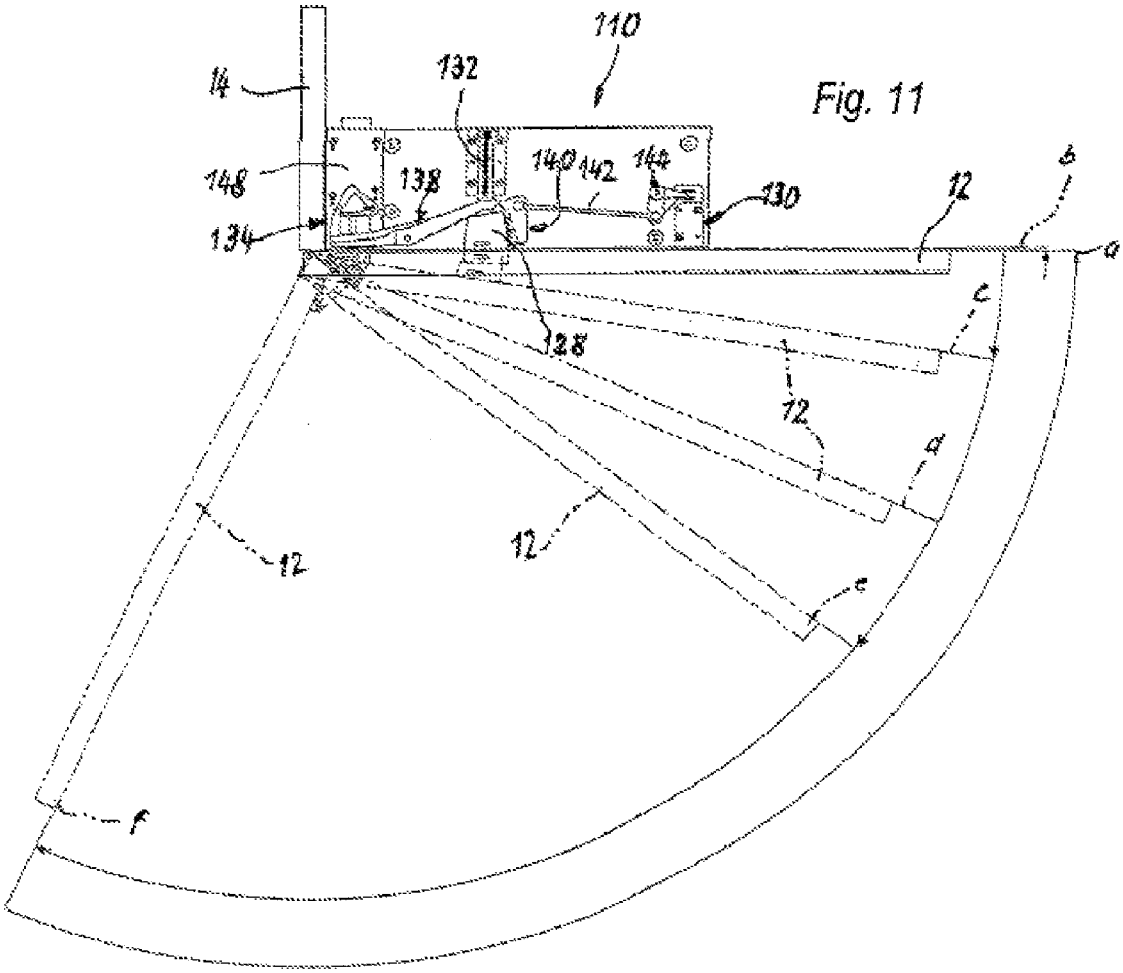
FIG. 11 shows a top view opening device viewed in the direction of the arrow 11 in FIG. 10, wherein the door leaf is shown by dash-dot lines in the closed position and additionally in four further intermediate positions and the open positions.

In FIG. 11 the door leaf 12 is shown in the aforementioned closed position a, and in addition further positions b to f between which the door leaf 12 is pivotable are shown by dash-dot lines.

Of these additional pivoted positions the position identified by b denotes a position in which the door leaf 12 is additionally forced by exertion of a pressure on its front face by a small angle in the direction of the interior of the carcass. In this case a thrust piece 131 of a trigger unit 130 also projects out of the front end face 118*a* of the housing 118 of the opening device and is forced by the door leaf 12 into the interior of the housing, and then in the manner described below in connection with FIGS. 13*a* to 14*f* the trigger unit unlocks the ejector ram 128 which until then is retracted into the housing 118 in the position shown in FIG. 10, so that the ejector ram is forced out of the opening 126 by the bias of a spring 132 and forces the door leaf 12 into the position denoted by c. In this position the travel of the ejector ram 28 is ended and the door leaf 12 can be pivoted via the positions d and e into the completely opened position f, wherein in the pivot region of the door leaf 12 between the positions c and e via the rod component 122 articulated on the door leaf 12 the motion thereof is transmitted to a spring-biased slide to a tensioning and stopping device 134 provided in the housing 118, of which the construction and operation are explained in greater detail below in connection with FIGS. 12 to 14*f*.

Figure 12:
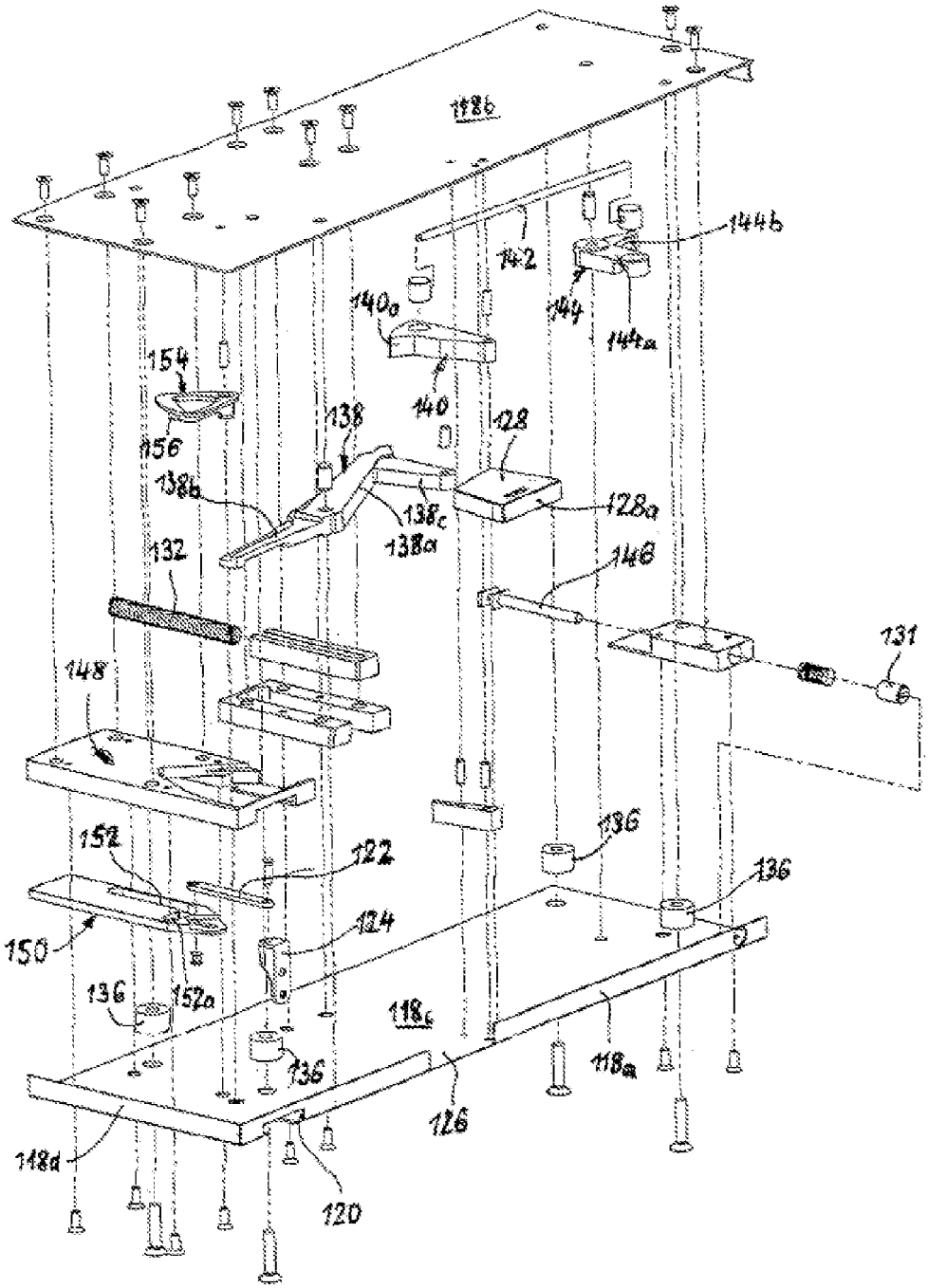
FIG. 12 shows an exploded view of the opening device shown in FIGS. 10 and 11 in an isometric representation.

The opening device 110 is shown in FIG. 12 in an exploded view which shows the construction of the individual components. The housing 118 has an upper and a lower flat top wall 118*b* and 118*c*, each rectangular in plan view, which in the proper mounted position are retained so as to be aligned in a predetermined spacing with respect to one another by—in the illustrated case—four cylindrical distance pieces 136 each provided with a central through hole, wherein the elongate front side wall 118*a* is formed by strip-shaped regions of the original flat sheet metal blank of the top wall which are bent upwards at right angles from the lower top wall 118*c*. The through opening 120 for the rod component 122 and the through opening 126 for the ejector ram 128 as well as the through opening for the thrust piece 131 are formed by stamping out of the bent side wall 118*a*. The height of the distance pieces 136 is chosen to be equal to the height of the front side wall 118*a* measured in the vertical direction, so that the elongate side wall 118*a* closes the front face of the housing 118—except for the aforementioned stamped-out openings.

The housing 118 can also be closed peripherally along the other boundary edges of the top walls 118*b* and 118*c* by upwardly bent strip-shaped sheet metal sections. In FIG. 3 in addition to the strip-shaped side wall 118*a* only the strip-shaped end wall 118*d* which is bent upwards from the top wall 18*c* shown in the drawing at bottom left of the lower top wall 18*c*.

Between the top walls 118*b*, 118*c* a two-armed lever component 138 is mounted in the housing 118 so as to be pivotable about a vertical axis, the lever arms 138*a*, 138*b* of which are directed in each case in the opposite direction to the narrower side walls of the housing 118. In the end region of the lever arm 138*a* the ejector ram 128 is connected by way of an extension 138*c* bent down from the lever arm 138*a* so as to be pivotable and additionally to be lateral displaceable to a limited extent. The ejector ram designed as a flat plate component is guided with its flat thrust face 128*a* directed towards the door leaf in the through opening 126 between the top walls 118*b*, 118*c*. The aforementioned spring 132 under compression pretension acts on the lever arm 138*a* for the purpose of a pivoting movement which pushes the ejector ram 128 out of the through opening until the lever arm 138*a* rests on the inner face of the side wall 118*a*.

Apart from the free end of the lever arm 138*a* a latching component constructed as a pivot lever 140 is disposed in the housing and has on its free end facing the free end of the lever arm 138*a* a locking projection 140*a* which in the retracted locked position of the ejector ram 128 engages under the free end of the lever component 138*a* and fixes the lever component in the retracted locked position against the bias of the spring 132 acting on it.

On its end opposite the end on the pivot bearing side the pivot lever 140 is coupled via an elongate tension/compression element 142 to the free end of a lever arm 144*a* of a toggle lever 144. The toggle lever 144 is part of the aforementioned trigger unit 130. The second lever arm 144*b* of the toggle lever is coupled to an elongate ram 146 which is biased under compression pretension in the direction of a position where it is forced out of the housing 118 and on the free end of which remote from the toggle lever there is fixed the thrust piece 131 which projects by a small amount from the front face of the side wall.

The toggle lever 144 can be pivoted via the ram 146 engaging on the lever arm 144*b* by pressing of the thrust piece 131 into the interior of the housing in such a way that by way of the tension/compression element 142 the lever arm 144*a* of the toggle lever pivots the pivot lever 140, wherein the locking projection 140*a* of the pivot lever is drawn back from its position where it engages under the free end of the lever am 138*a*. Due to the compression pretension of the spring 132 the lever component 138 is then pivoted and the ejector ram 128 coupled to the lever arm 138*a* is forced outwards out of the retracted locked position. The pressure surface 128*a* of the ejector ram 128 resting on the inner face of the closed door leaf 12 pivots the door leaf into the partially opened position denoted by c in FIG. 11.

The lever arm 138*b* of the two-armed lever component 138 co-operates with the aforementioned tensioning and stopping device 134 which has a flat slide 150 which is guided so as to be horizontally displaceable parallel to the supporting wall 14 of the carcass in a guide housing 148 disposed in the housing, wherein one end of the rod component 122 is coupled so as to be pivotable and longitudinally displaceable by a predetermined amount in the front end region of the slide on the door leaf side. The other end of the rod component 122 is—as mentioned above—articulated on the fixing bracket fixed on the inner face of the door leaf. Thus when the door leaf 12 is opened out of the closed position into the open position the pivoting movements of the door leaf are transmitted via the rod component 122 to the slide 150, that is to say the slide is withdrawn from the position inserted into the guide housing 148 (FIG. 13*a* and FIG. 14*b*) as far as the position shown in FIGS. 13*f* and 14*f* in which its front end coupled to the rod component 122 is withdrawn through the through opening 120 to a point in front of the housing side wall 118*a*.

A control groove 152 extending in a substantially straight line over the greater part of its length in the slide withdrawal direction is made in the slide, the said control groove being rounded on its front end outside the carcass and merging into a short end portion 152*a* extending at right angles to the straight region. A control projection 156 projecting from the underside of a segment-shaped control disc 154 pivotably mounted on the guide housing 148 engages in the control groove. When the door leaf is opened the outer segment surface 156*a* lying opposite the pivot axis of the control disc 154 comes to rest on a matching surface of the lever arm 138*b* which is then pivoted during its pivoting action by the co-operation of the control projection 156 engaging in the control groove 152 and pivots the lever arm 138*b* in the sense of pivoting the lever component in the clockwise direction, so that the lever arm 138*a* of the lever component 138 retracts the ejector ram 128 into the interior of the housing. In the completely retracted locked position of the ejector ram 128 the locking projection 140*a* then passes again below the free end of the lever arm 138*a* and the ejector ram 128 is locked in the retracted position. The door leaf 12 can then be led back out of the completely opened position (FIG. 13*f*, FIG. 14*f*) practically without force into the closed position (FIG. 13*b* and FIG. 14*b*), wherein the slide 150 is pushed back into the housing 118 via the rod component 122 and the control disc 154 is pivoted clockwise by way of its control groove 152 and the control projection 156 so that its sector-shaped control surface is lifted off from the matching control surface on the lever arm 138*b* as the closed position is approached and the control projection 156 passes over into the end portion 152*a* of the control groove 152 as the closed position is reached.

Figure 13A:
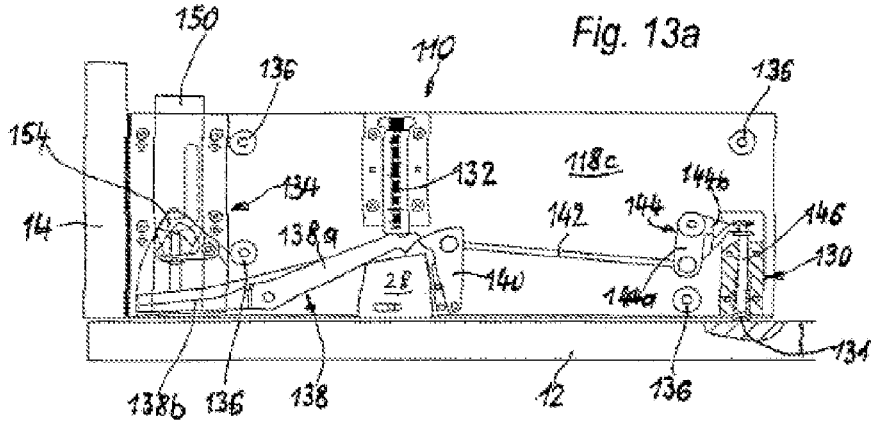
FIGS. 13*a* to 13*f* show views in the direction of viewing according to FIG. 11 but on an enlarged scale in which the functional parts of the opening device are each shown in the different positions of the door leaf shown schematically in FIG. 11.
Figure 13B:
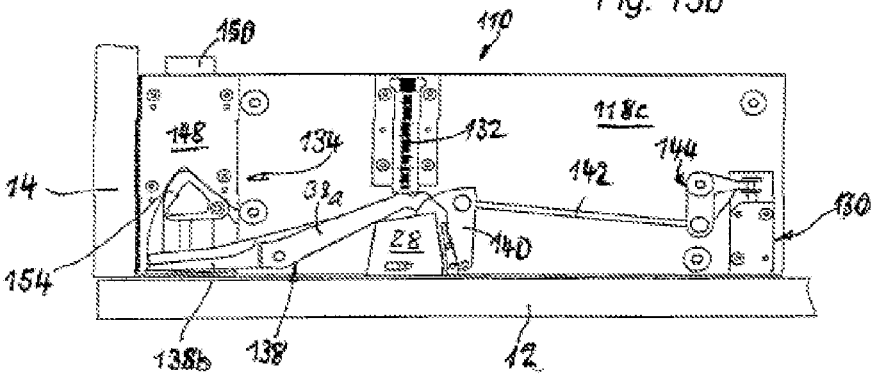
Figure 13C:
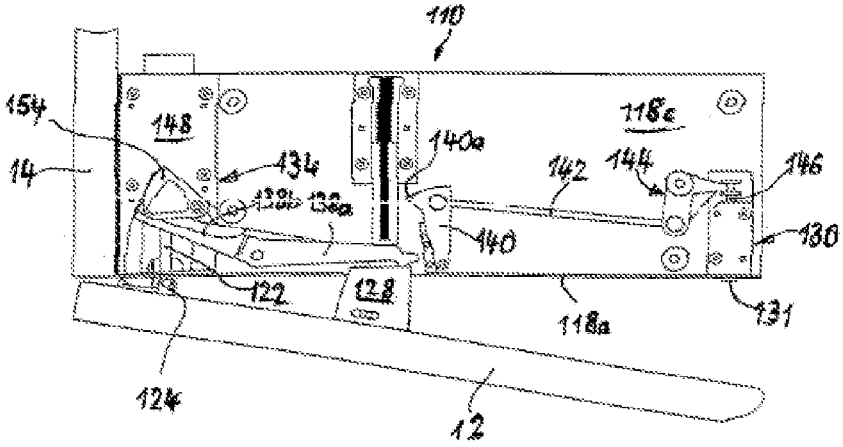
Figure 13D:
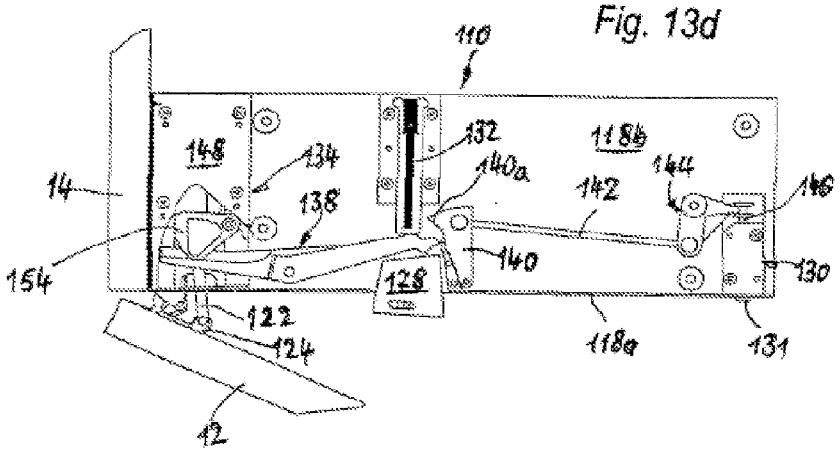
Figure 13E:
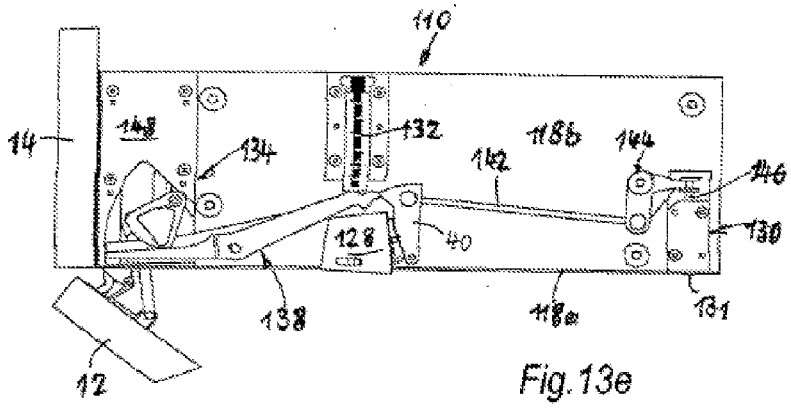
Figure 13F:
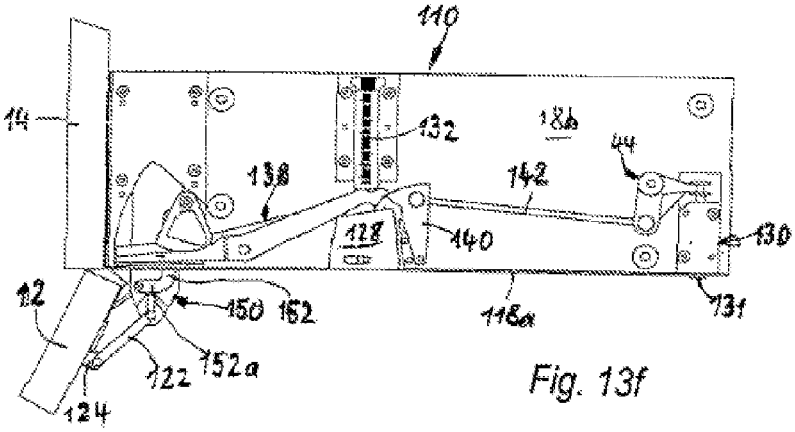
Figure 14D:
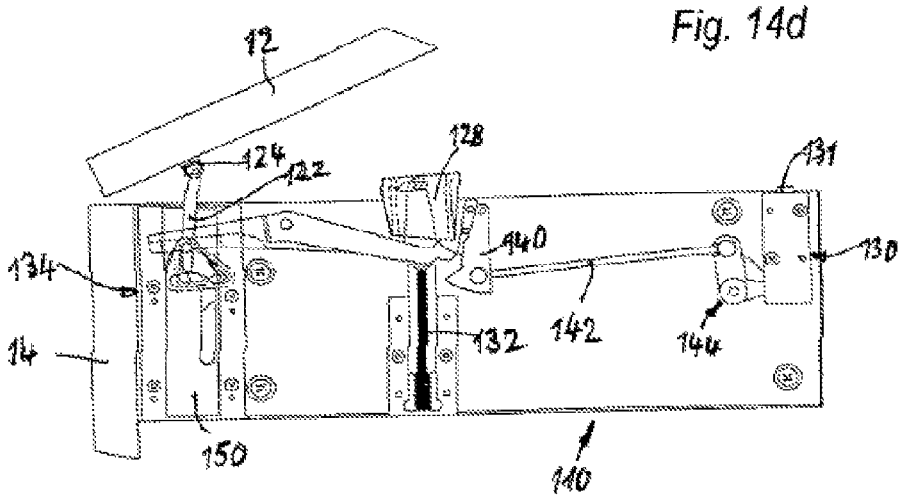
Figure 14E:
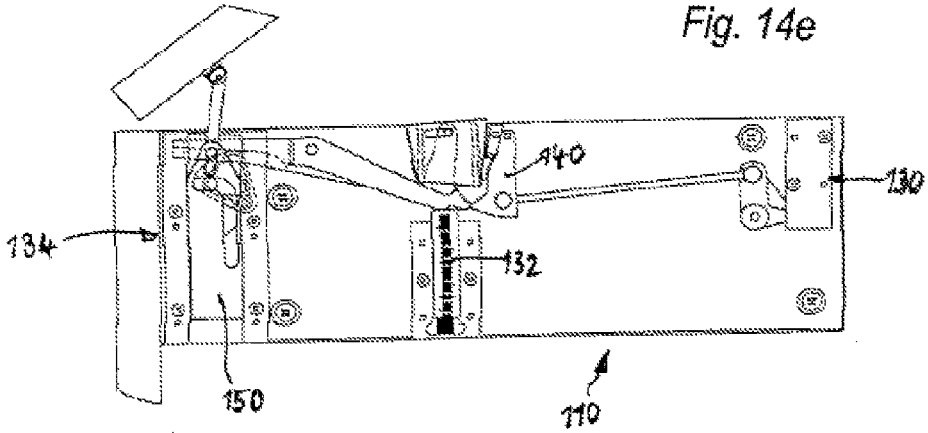
Figure 14F:
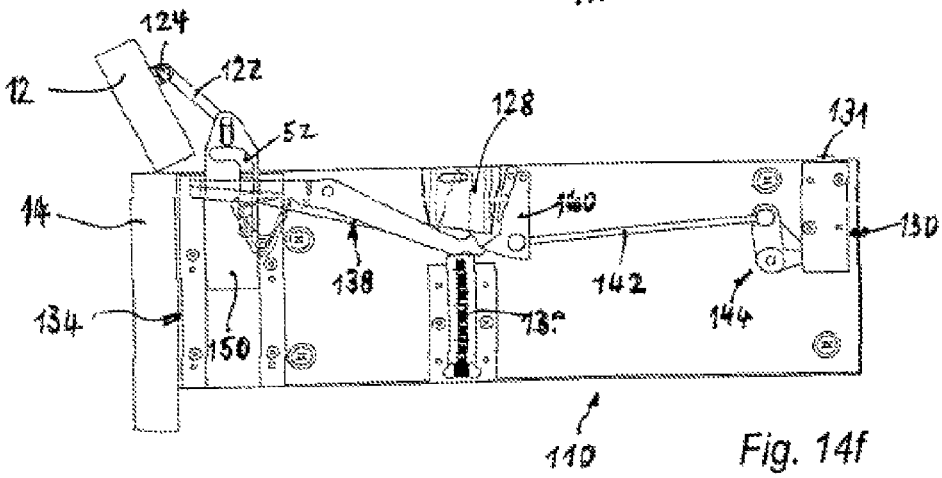

The co-operation of the functional components of the opening device 110, and their respective position in the closed or open positions of the door leaf 12 denoted by a to f in FIG. 11, is shown in FIGS. 13*a* to 13*f* and 14*a* to 14*f* respectively. It can be seen that when the door leaf 12 is pushed by a very small angular amount in the direction of the interior of the cabinet carcass out of the position a into the position b the inner face of the door leaf 12 the thrust piece 131 pivots the lever arm 144*e* of the toggle lever 144 via the ram 146, whereby the second lever arm 144*a* is retracted by way of the tension/compression element 142 pivoting the pivot lever 140 out of the position in which it engages with its locking projection 140*a* under the free end of the lever arm 138*a* of the lever component 138. Due to the bias of the spring 132 acting on the lever arm 138*a* the lever arm 138*a* which is then unlocked and the ejector ram 126 coupled thereto is forced out of its position in which it is almost completely retracted into the housing through the through opening 126 and out of the housing, the door leaf 12 being pivoted up automatically into the position c. However, further pivoting of the lever arm 138*a* is then prevented by contact of the lever arm 138*b* of the lever arm 38*a* on the adjacent distance piece 136, so that as opening proceeds further the door leaf 12 is lifted off from the pressure surface 128*a* of the ejector ram 128 (FIG. 13*d*). The slide 150 of the tensioning and stopping device 134 is then drawn forwards by way of the rod component 122 articulated on the fixing bracket 124, wherein in co-operation with the control projection 156 engaging in the control groove 152 of the slide 150 the control disc 154 is pivoted and in turn by pressure on the lever arm 138*b* pivots the lever component 138 back against the tension of the spring 132. Due to the coupling of the ejector ram 128 on the lever arm 138*a* of the lever component 138 this latter is then retracted into the housing 118. When the position of the components illustrated in FIG. 13*f* is reached, the free end of the lever arm 138*a* passes over the locking projection 140*a* of the pivot lever 140 and thus is locked in the retracted position of the ejector ram 128. The door leaf 12 can then be pivoted back into the closed position largely without force, the slide 150 then being pushed back by the rod component 122 into the guide housing 148. In this displacement operation, as the closed position of the door leaf is approached the control disc 154 is pivoted back so that it is lifted off from the matching surface on the lever arm 138*b*. Then as the closed position is approached the control projection 156 moves over into the end portion 152*a* of the control groove 152.

It can be seen that within the scope of the idea underlying the invention modifications and variants of the described embodiments of the opening devices can be made according to the invention. Thus the opening device of the first embodiment which is described as an assembly to be installed separately can basically also be combined with the hinges of a cabinet or can be integrated into the hinges. In this case it is merely important that the kinematic construction is such that the ejector ram which displaces the door leaf after the release of the pawl from the latching recess at the start of the opening operation is displaced again as pivoting proceeds further into the completely open position by way of the rod component articulated on the door leaf, the ejector ram being moved back into the retracted position and automatically held locked in this position until the latching engagement of the pawl is released again by deliberate manipulation by a user. The manipulation of the pawl can take pace for example by remote control via a Bowden cable or a push or pull rod linked to an outer actuating element. As an alternative electrical actuation is also conceivable, in which the pawl is constructed as an armature or is connected to such an armature which is pulled up by application of a voltage to an associated electric coil. In this connection wireless remote triggering of the armature coil is also conceivable.

Also in the second embodiment parts of the functional groups created in the opening device 10 by the co-operation of mechanical components can be replaced by electrical or electronic components such as proximity sensors, magnetic armature components, etc.

The invention claimed is:

1. An opening device (110) comprising: an elongate ejector ram (128) which is mounted so as to be longitudinally movable in or on a housing (118), wherein the ejector ram (128) is biased by a spring (132) into a position projecting out of the housing (118) and forceable back against a bias of the spring into an interior of the housing, a releasable locking device (140, 140*a*) locks the ejector ram (128) in a position in which the ejector ram is retracted into the housing (118) and, a two-armed lever component (138) including a first lever arm (138*a*) and a second lever arm (138*b*) pointing substantially in opposing directions is mounted so as to be pivotable in the housing (118), that when biased the ejector ram (128) is disposed in an end region of the first lever arm (138*a*) and a latching component of the locking device is provided which locks the end region of the first lever arm (138*a*) in a pivoted position of the lever component associated with a retracted position of the ejector ram (128), and that a tensioning and stopping device (134) is coupled to an end region of the second lever arm (138*b*) of the lever component (138), wherein the tensioning and stopping device (134) has a rod component (122) as a tensioning element coupled to a flat slide (150) mounted displaceably in the interior of the housing, wherein the slide (150) is provided with a crank-shaped control groove (152) which extends substantially in a straight line portion over substantially a length of the slide (150) but which merges into a short end portion (152*a*) extending substantially at a right angle to the straight line portion, and a control projection (156) which is provided on a flat segment-shaped control disc (154) pivotably disposed in the housing (118) engages in the control groove (152, 152*a*) and which, when the opening device is in a closed position, the control projection (156) is located in the short end portion of the control groove and which, when the opening device is in an opened position, the control projection (156) is moved into the straight line portion of the control groove (152) by movement transmitted by the rod component to the slide as the control disc (154) pivots, and thus enables the slide (150), which until then was retained by engagement of the control projection (156) in the short end portion, to move.

2. The opening device as claimed in claim 1, wherein the housing (118) is dimensioned in a longitudinal direction of a pivot axis of the lever component (138) so that spacing between substantially flat top walls (118*b*, 118*c*) of the housing which accommodate the lever component (138) is approximately equal to a thickness of the lever component (138) in a region of the pivot axis, wherein the top walls (118*b*, 118*c*) of the housing have edges near the ejector ram at least partially closed by a side wall (118*a*) with a through opening (126) defined therein for receiving the ejector ram (128).

3. Arrangement of an opening device (110) as claimed in claim 2 on a cabinet with a door leaf (12) articulated pivotably on the cabinet, wherein the housing (118) of the opening device (110) is disposed in the cabinet with one of the housing top walls (118*b*) resting on an inner face of an upper top wall or a base of the cabinet in such a way that the pressure surface (128) of the ejector ram (128), which in the retracted position projects only slightly from the side wall (118*a*) of the housing (118), rests substantially on the inner face of the door leaf (12) which is in the closed position.

4. The opening device as claimed in claim 2, wherein the ejector ram (128) is a flat plate component displaceably guided between inner faces of the top walls (118*b*, 118*c*) of the housing and has on an end wall side a flat pressure surface (128*a*) which, when the ejector ram (128) is retracted in the housing, projects over the side wall (118*a*) in the through opening.

5. The opening device as claimed claim 4, wherein the ejector ram (128) is articulated on the first lever arm (138*a*) of the lever component (138) so as to be pivotable about an axis offset into the interior of the housing with respect to the flat pressure surface (128*a*).

6. The opening device as claimed in claim 5, wherein in addition to pivotable articulation on the first lever arm (138*a*) the ejector ram (128) is disposed so as to be additionally displaceable by a predetermined amount substantially parallel to the flat pressure surface (128*a*).

7. The opening device as claimed in claim 5, wherein the ejector ram (128) is a flat body which is delimited so as to be flat on both sides in the regions opposite the top walls (118*b*, 118*c*) of the housing and of which a thickness measured between the opposing flat sides corresponds approximately to spacing between inner faces of the top walls (118*b*, 118*c*) of the housing.

8. The opening device as claimed in claim 7, wherein the rod component (122) is coupled to the slide (150) so as to be pivotable and displaceable to a predetermined extent in a direction of displacement of the slide.

9. The opening device as claimed in claim 1, wherein the latching component of the locking device is constructed as a pivot lever pivotably mounted between the top walls (118*b*, 118*c*) of the housing with a latching projection (140*a*) provided on a free end of the pivot lever opposite an end on a pivot bearing side, and in the retracted position the latching projection (140*a*) engages under the first lever arm (138*a*) of the lever component (138) associated with the ejector ram (128) and thus fixes the lever component (138) in the retracted position.

10. The opening device as claimed in claim 9, wherein the pivot lever (140) is coupled by gearing to a trigger unit (130) which is disposed so as to be spaced from the pivot lever and has a thrust piece (131) which is biased into a position projecting over the side wall (118*a*) of the housing (118) and of which insertion movement produced when a pressure is exerted in a direction of the interior of the housing is converted by geared coupling into a pivoting of the pivot lever (140) for the purpose of a release of a locked end of the first lever arm (138*a*).

11. The opening device as claimed in claim 10, wherein the pivot lever (140) on the free end opposite the end on the pivot bearing side is coupled via an elongate tension/compression element (142) to a first lever arm (144*a*) of a pivotable toggle lever (144), while a second lever arm (144*b*) of the pivotable toggle lever (144) is coupled to a thrust piece (131).

* * * * *